US006578824B2

(12) United States Patent
Samejima

(10) Patent No.: US 6,578,824 B2
(45) Date of Patent: Jun. 17, 2003

(54) OVERLOAD-PREVENTING DEVICE FOR WINCH

(75) Inventor: Yasuhiro Samejima, Osaka (JP)

(73) Assignee: Vital Kogyo Kabushiki Kaisha (JP)

( * ) Notice: Subject to any disclaimer, the term of this patent is extended or adjusted under 35 U.S.C. 154(b) by 0 days.

(21) Appl. No.: 09/840,429

(22) Filed: Apr. 23, 2001

(65) Prior Publication Data

US 2002/0153520 A1 Oct. 24, 2002

(51) Int. Cl.[7] ..... B66D 3/12
(52) U.S. Cl. ..... 254/366; 254/352; 254/903
(58) Field of Search ..... 254/903, 359, 254/352, 365–366, 372

(56) References Cited

U.S. PATENT DOCUMENTS 4,664,357 A 5/1987 Nishimura
4,690,379 A * 9/1987 Nakamura ..... 192/223.4
4,768,754 A * 9/1988 Nishimura ..... 254/351
5,305,989 A * 4/1994 Nishi et al. ..... 254/352
5,575,457 A * 11/1996 Inoue et al. ..... 192/95
5,641,151 A * 6/1997 Kataoka ..... 192/111 B
6,059,267 A * 5/2000 Nishimura ..... 192/95
6,224,039 B1 * 5/2001 Okamoto et al. ..... 254/346

FOREIGN PATENT DOCUMENTS

JP 1-17994 1/1989
JP 04272094 A * 9/1992 ..... B66D/3/20

* cited by examiner

*Primary Examiner*—Kathy Matecki
*Assistant Examiner*—Sang Kim
(74) *Attorney, Agent, or Firm*—Vedder Price Kaufman & Kammholz

(57) ABSTRACT

The present invention provides an overload-preventing device for a winch, by which even an overload is caused to descend. The overload-preventing device includes an accommodation hole that is formed in a rotation drive member and is open in the contact plane with a pressing drive member and accommodates a movable piece pressing member and a movable piece. The movable piece is pressed to the side of the pressing drive member by the movable piece pressing member. An engagement groove having a depth in which approx. half of the movable piece can be driven is formed at a part of the contact plane of the pressing drive member. The unwinding side of the engagement groove is formed at the fitting plane while the winding-up side thereof is formed on the inclined surface.

4 Claims, 6 Drawing Sheets

OVERLOAD-PREVENTING DEVICE FOR WINCH

FIELD OF THE INVENTION

The present invention relates to an overload-preventing device that is applied to a winch such as a chain block, a manual hoist, etc.,

BACKGROUND OF THE INVENTION

The applicant previously proposed an overload-preventing device for a winch, which is disclosed in Japanese Patent Publication No. 17994 of 1989. The overload-preventing device includes, as shown in FIG. 7, a drive shaft b that transmits a rotating force to a load sheave a; a pressure-receiving member c that is fixed at the drive shaft b; a pressing drive member g that is screwed with the drive shaft b so as to advance and retreat and presses and rotates the pressure receiving member c via a reverse rotation preventing wheel d that is fitted to the outside of the pressure receiving member c and a pair of friction members e and f that are disposed at both sides thereof; a rotation drive member j that is not permitted to rotate with respect to the pressing drive member g but is movable in the axial direction, has an outer circumferential surface of a truncated cone member h, the diameter of which is reduced toward the side of the pressure-receiving member c, and an inner circumferential surface following the outer circumferential surface of the truncated cone member h, and is outwardly fitted so that it is brought into frictional contact with the tip end side face in the axial direction of the truncated cone member h and pressing drive member g; wherein the truncated cone member is pressed toward the pressing drive member by a truncated cone pressing member. In the device, if the rotation torque of the rotation drive member, which is necessary for winding-up, exceeds the friction force given between the rotation drive member and the truncated cone portion or the pressing drive member by the truncated cone pressing member, the rotation drive member runs idly, whereby it is possible to prevent an overload applied to the rotation drive member from being added to the drive shaft, and influences due to wearing resulting from the friction can be reduced by making the contacted surface between the rotation drive member and the truncated cone member conical surface.

SUMMARY OF THE INVENTION

However, in a prior art construction, when an overload-preventing device operates due to an overload resulting from an accidental impact in the process of unwinding a load, the rotation drive member slips with respect to the truncated cone member and pressing drive member. Therefore, there was a fear that the operation of the winch would be disabled. Therefore, a load is hung dangling from a chain suspended from a load sheave, wherein there is a fear that the load cannot be unload or unwound. Also, where an overload is applied due to a load crumble after the load is tightened by a lever hoist, a rope cannot be slackened, wherein there is a fear that the rope must be cut off.

The present invention was developed to solve the above-mentioned themes.

The present invention applies to a winch that includes a drive shaft that transmits a rotating force to a load sheave; a pressure-receiving member that is fixed at the drive shaft; a pressing drive member that is screwed with the drive shaft so as to advance and retreat, and presses and rotates the pressure receiving member via a reverse rotation preventing wheel that is fitted to the outside of the pressure receiving member and via a pair of friction members that are disposed at both sides thereof; a truncated cone member, the diameter of which is reduced toward the side of the pressure-receiving member, that is not permitted to rotate with respect to the pressing drive member but is movable in the axial direction; and a rotation drive member, having an inner circumferential surface following the outer circumferential surface of the truncated cone member, which is outwardly fitted so that it is brought into frictional contact with the outer circumferential surface of the truncated cone member and the tip end side face in the axial direction of the pressing drive member; wherein the truncated cone member is pressed toward the pressing drive member by a truncated cone pressing member.

And, the overload-preventing device of a winch according to the invention is featured in that, in the winch as described above, an accommodation hole for accommodating a movable piece is formed in the abovementioned rotation drive member so as to open in the contact surface with the pressing drive member, the movable piece is retained so as to come out of and sink in the accommodation hole but not to move in the circumferential direction, the abovementioned movable piece is pressed to the side of the pressing drive member by the movable piece pressing member, an engagement groove having a depth in which a part of the movable piece has infiltrated is formed on the same radius as that of the accommodation hole on the contact surface of the pressing drive member, the engagement groove has a length by which the movable piece can move in the circumferential direction, the end portion at the winding-up side is formed so that it becomes shallow toward the winding-up side to become continuous on the contact surface, and the end portion at the unwinding side is formed on the fitting plane on which the movable piece cannot move in the unwinding direction.

Also, the overload-preventing device of a winch according to the invention is featured in that, in the winch as described above, an accommodation hole for accommodating a movable piece is formed in the pressing drive member so as to open in the contact surface with the rotation drive member, the movable piece is retained so as to come out of and sink in the accommodation hole but not to move in the circumferential direction, the abovementioned movable piece is pressed to the side of the rotation drive member by the movable piece pressing member, an engagement groove having a depth in which a part of the movable piece is absorbed is formed on the same radius as that of the accommodation hole on the contact surface of the rotation drive member, the engagement groove has a length by which the movable piece can move in the circumferential direction, the end portion at the unwinding side is formed so that it becomes shallow toward the unwinding side to become continuous on the contact surface, and the end portion at the winding-up side is formed on the fitting plane on which the movable piece cannot move in the winding-up direction.

Also, in addition to any one of the above-mentioned constructions, the abovementioned pressing drive member has a flange portion formed at the side of the pressure-receiving member, and has a boss portion extending and formed in the direction opposed to the pressure-receiving member. The abovementioned truncated cone member is spline-fitted to the base end portion of the boss portion, and the above-mentioned truncated cone pressing member is fitted to the outer side of the intermediate portion thereof and is positioned by a nut. It is preferable that the flange portion of the abovementioned pressing drive member is constructed so that one end thereof is brought into contact with the abovementioned friction member while the other end thereof is brought into contact with the abovementioned rotation drive member.

As described in detail, according to a chain block of the invention, in the case where the rotation drive member rotates in the unwinding direction, the rolling member that is pressed by the movable piece pressing member is brought into contact with the fitting plane of the engagement groove, wherein since rotation of the rotation drive member is transmitted to the pressing drive member, unwinding operation of the drive shaft is enabled in an overloaded state. Therefore, a situation will not occur where an overload is suspended or a rope used for the tightening of a crumbled load is cut off.

Furthermore, in the case where the rotation drive member is caused to rotate in the winding-up direction, the rolling member is pushed up onto the frictional plane along the inclined plane, wherein a rotation force of the rotation drive member is not transmitted to the pressing drive member via the rolling member. Therefore, the slipping motion of the rotation drive member with respect to the pressing drive member is not hindered even in an overloaded state, and the overload-preventing function is not hindered.

DESCRIPTION OF EMBODIMENTS OF THE INVENTION

Hereinafter, a further detailed description is given of the overload-preventing device of a winch according to the invention.

Figure 1:
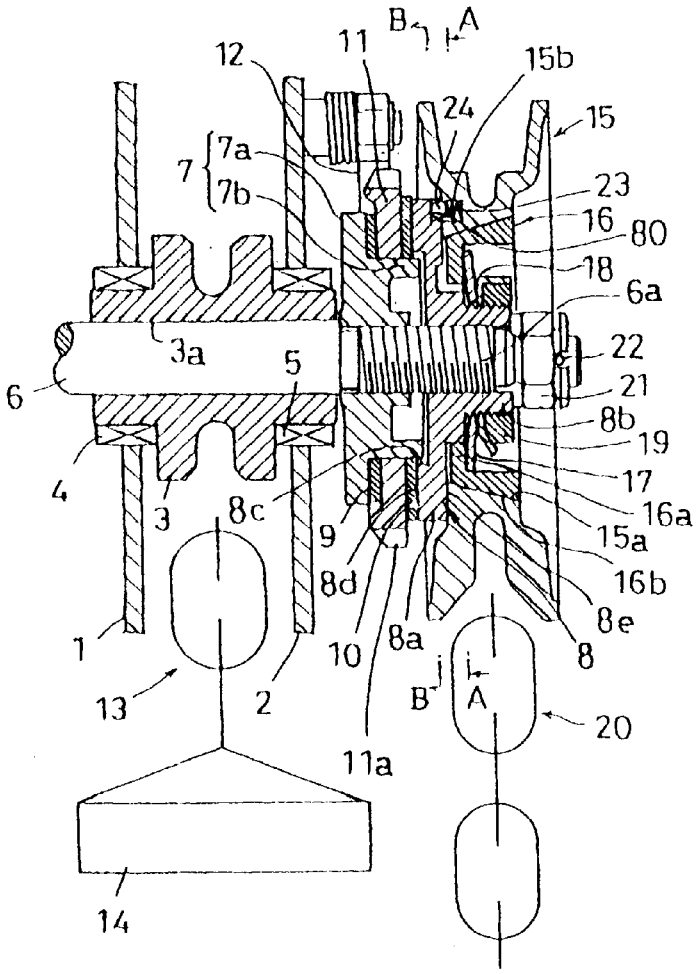
FIG. 1 is a sectional view of the major parts showing one embodiment of a chain block to which an overload-preventing device according to the invention is applied.
Figure 2:
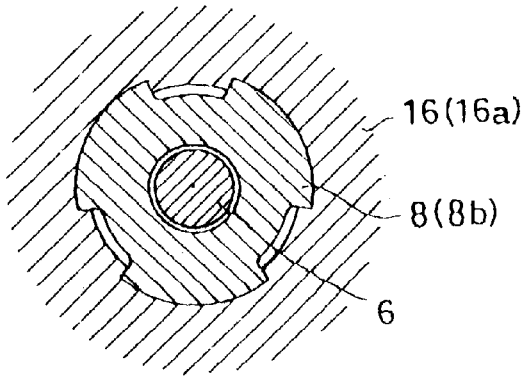
FIG. 2 is a cross-sectional view taken along the line A—A, showing the relationship between the pressing drive member 8 and the truncated cone member 16 in FIG. 1.
Figure 3A:
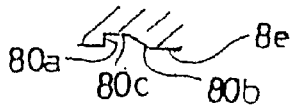
FIG. 3(*a*) is a cross-sectional view taken along the line C—C in FIG. 3(*b*), and FIG. 3(*b*) is a cross-sectional view, taken along the line B—B, showing the pressing drive member 8 in FIG. 1.
Figure 3B:
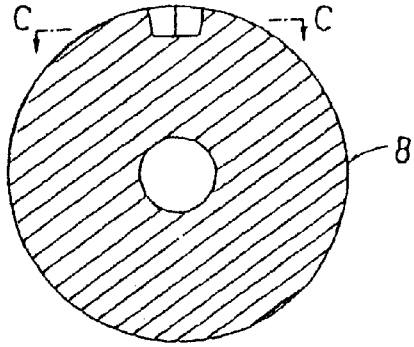
Figure 4A:
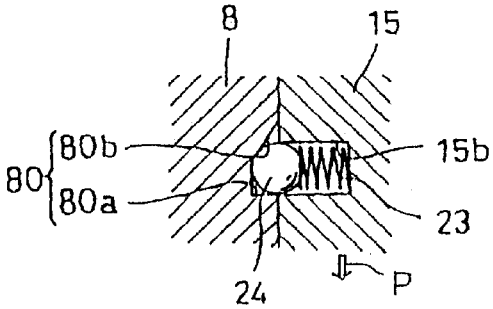
FIGS. 4(*a–d*) shows both an engaged state and a disengaged state between the pressing drive member and rotation drive member of the chain block shown in FIG. 1, wherein (*c*) shows an alternative engaged state, and (*d*) shows an alternative disengaged state.
Figure 4B:
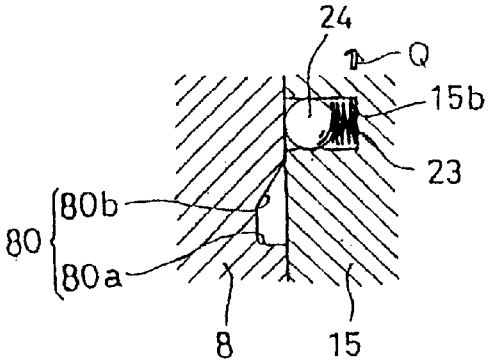
Figure 4C:
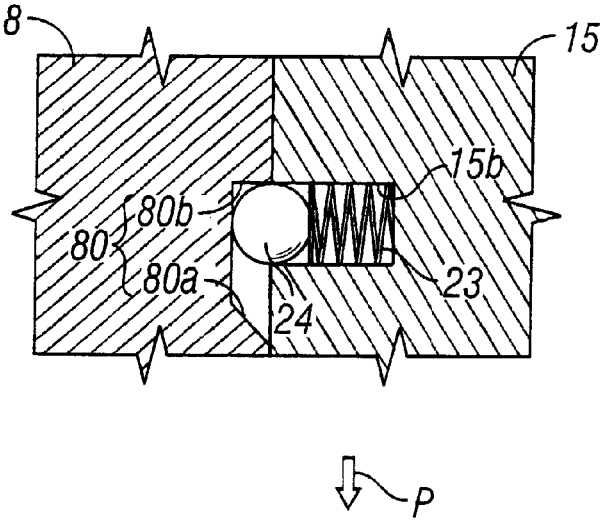
Figure 4D:
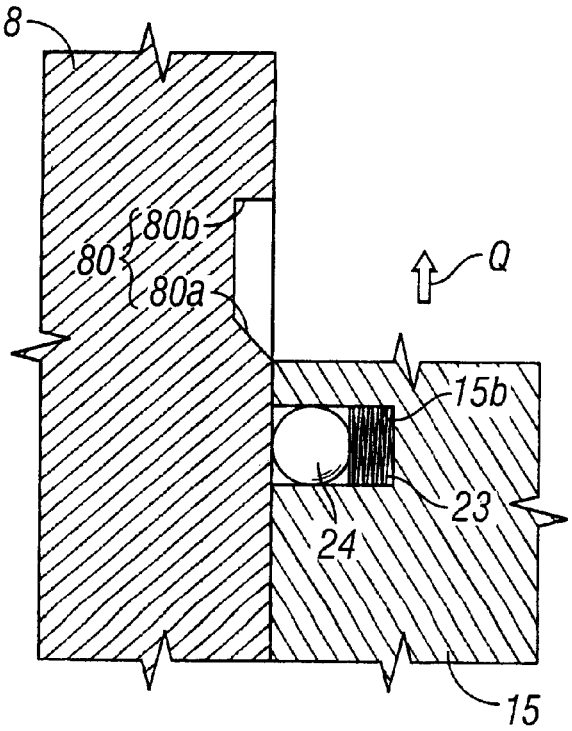
Figure 6:
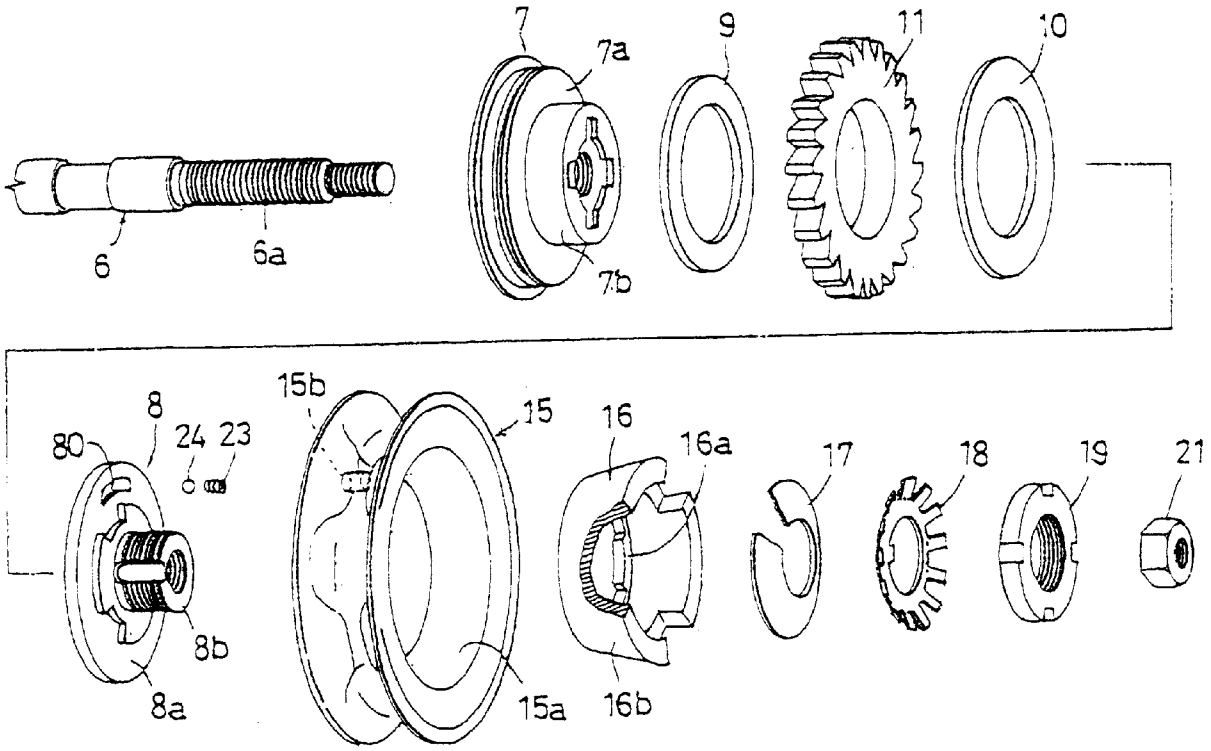
FIG. 6 is a disassembled perspective view of the major parts of the chain block shown in FIG. 1.
Figure 7:
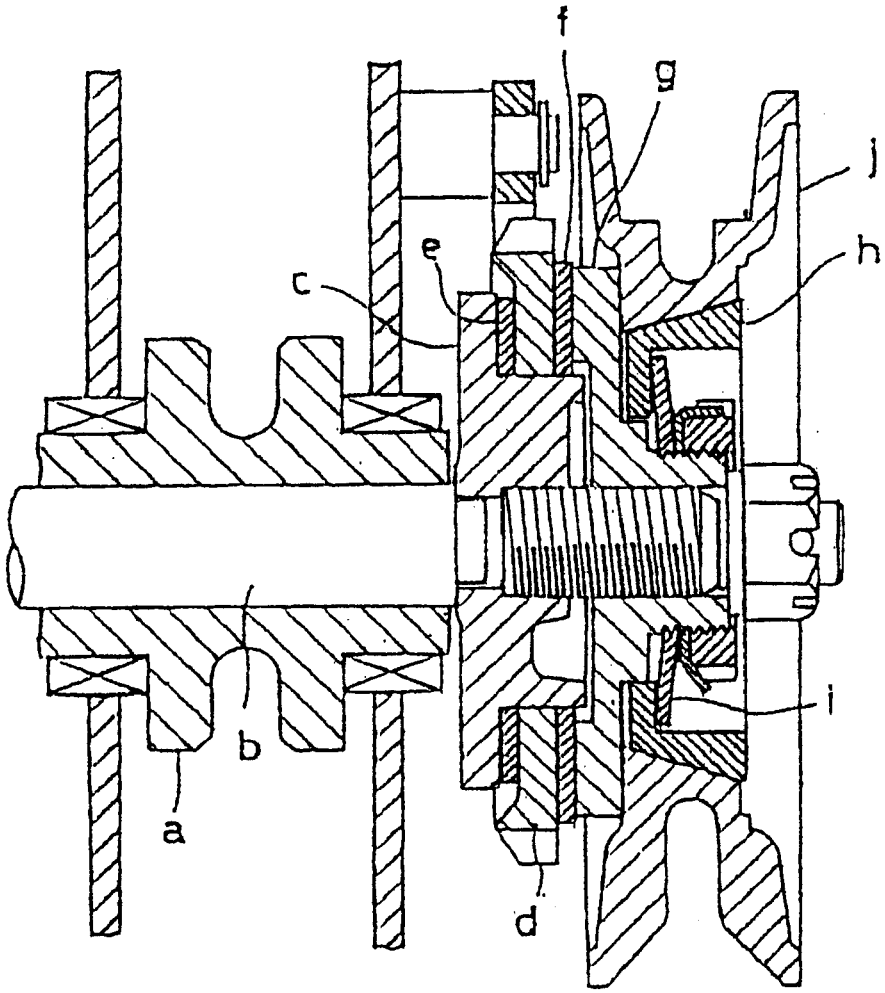
FIG. 7 is a sectional view showing one example of a chain block with an overload-preventing device according to a prior art.

FIG. 1 is a sectional view showing one embodiment of a chain block to which the overload-preventing device according to the invention is applied. Also, FIG. 6 is a partially disassembled perspective view of the major parts thereof. Furthermore, FIG. 2 and FIG. 3(*b*) are cross-sectional views taken along the lines A—A and B—B in FIG. 1. Also, FIG. 3*a* is a cross-sectional view taken along the line C—C in FIG. 3*b*.

In FIG. 1, a load sheave 3 is provided between a pair of side plates 1 and 2 which are retained in parallel to each other at a fixed interval, and the load sheave 3 is retained so as to rotate by bearings 4 and 5 that are supported by the side plates 1 and 2. An axial hole 3*a* penetrates the center portion of the load sheave 3. A drive shaft 6 is inserted into the axial hole 3*a* so as to rotate. Both ends of the drive shaft 6 protrude from both right and left ends of the abovementioned load sheave 3.

The protrusion portion at the left side of the drive shaft 6 is coupled to the load sheave 3 via a train of speed reducing and transmission gears (not illustrated). On the other hand, a male-threaded portion 6*a* is formed at the right protrusion portion of the drive shaft 6, and is provided with a means for driving the load sheave 3. That is, a pressure-receiving member 7 and a pressing drive member 8 are screwed with the male threaded portion 6*a* of the drive shaft 6 from the side plate 2, wherein the pressure-receiving member 7 is screwed extremely deeply into the male-threaded portion 6*a* and is fixed at the drive shaft 6.

The pressure-receiving member 7 is concentrically provided with a disk 7*a* having a large diameter and a boss 7*b* having a small diameter. The disk 7*a* is in proximity to the side plate 2 while the boss 7*b* is formed so as to extend to the tip end side (rightward) in the axial direction from the central portion of the disk 7*a*. A reverse rotation-preventing wheel 11 placed between a pair of friction members 9 and 10 is fitted to the outside of the boss 7*b* of the pressure-receiving member 7. The reverse rotation preventing wheel 11 and friction members 9 and 10 disposed at both sides thereof are constructed so as to be pressed to the disk 7*a* of the pressure-receiving member 7 by the pressing drive member 8.

The reverse rotation preventing wheel 11 is provided with engagement teeth 11*a* that are inclined in one of the circumferential directions at the outer circumference of the wheel 11. By the engagement teeth la being engaged with a ratchet claw 12 pivotally supported at the side plate 2, the reverse rotation preventing wheel 11 is prevented from reversely rotating, wherein the wheel 11 is permitted to rotate in only the winding-up direction.

Therefore, as the pressing drive member 8 normally rotates, the pressing drive member 8 moves toward the base end side (leftward) in the axial direction along the drive shaft 6, and the pressing drive member 8 presses the friction members 9 and 10 and reverse rotation preventing wheel 11 to the disk 7*a* of the pressure-receiving member 7, thereby causing the pressing drive member 8 and the pressure-receiving member 7 to be connected to each other. Accordingly, rotation of the pressing drive member 8 is transmitted to the load sheave 3 via the pressure-receiving member 7, drive shaft 6 and train of speed reducing and transmission gears, and a load 14 suspended from a link chain 13, which is wound in the load sheave 3, can be wound and lifted.

Figure 5A:
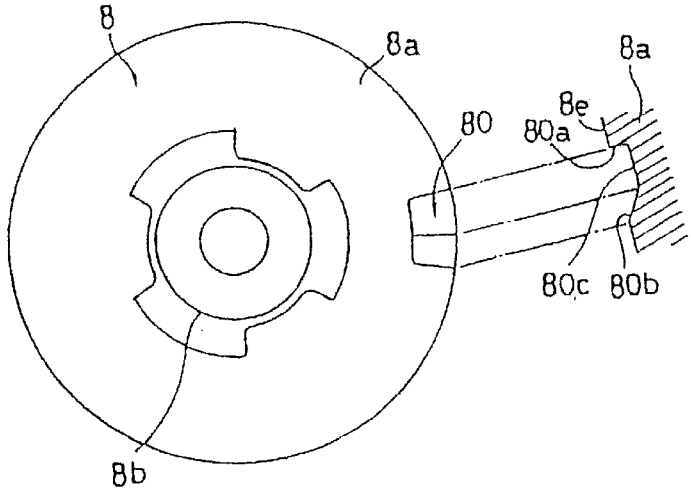
FIG. 5 shows the pressing drive member of the chain block shown in FIG. 1, wherein (*a*) is a plan view, and (*b*) is a sectional view of the central portion thereof.
Figure 5B:
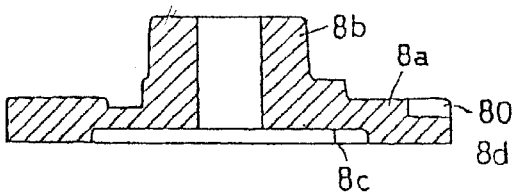

As shown in FIG. 1 and FIG. 5, in the pressing drive member 8, a flange portion 8*a* is formed at the base end side at the side of the pressure-receiving member 7 in the axial direction, and a boss 8*b* is formed so as to extend from the center portion of the flange 8*a* to the tip end side in the axial direction. Also, an insertion hole 8*c*, into which the tip end portion of the boss 7*b* of the pressure-receiving member 7 in the axial direction can be slightly inserted, is formed at the base end face of the flange 8*a* in the axial direction. The diameter of the insertion hole 8*c* is formed to be larger than the outer diameter of the boss 7*b* of the pressure-receiving member 7, so that the boss 7*a* is not directly brought into contact with the pressing drive member 8.

At the flange 8*a* of the pressing drive member 8, its base end face in the axial direction at the outside in the diametrical direction can be brought into contact with the friction member 10, and simultaneously its tip end face in the axial direction at the outside in the diametrical direction is disposed so as to be brought into contact with the rotation drive member 15 described later. That is, the base end face in the axial direction of the pressing drive member 8 opposed to the friction member 10 is made into a pressing frictional plane 8*d*, and the tip end face in the axial direction, which is opposed to the rotation drive member 15, is made into a supporting frictional plane 8*e*.

The base end portion of the boss 8*b* of the pressing drive member 8 is formed to have a larger diameter while the tip end portion thereof is threaded and is formed to have a smaller diameter. A truncated cone member 16 is provided so as to be fitted to the outside at the boss portion 8*b* of the pressing drive member 8. The truncated cone member 16 is formed to be roughly cylindrical so that the diameter thereof is gradually reduced toward the base end side in the axial direction, wherein an inner-oriented flange 16 brimmed inwardly in the diametrical direction is integrally formed at the base end portion in the axial direction. And, as shown in FIG. 2, the inner-circumferential portion of the inner-oriented flange 16*a* is spline-fitted to the portion having a large diameter at the base end side in the axial direction of the abovementioned boss portion 8*b*, and it can move in the axial direction with respect to the pressing drive member 8 while relative movement in the circumferential direction is checked.

A truncated cone pressing member (plate spring) 17 is fitted to the portion, having a small diameter, of the boss 8*b* of the pressing drive member 8, and the outer-circumferential portion of the truncated cone pressing member 17 is brought into contact with the tip end face in the axial direction of the inner-oriented flange 16*a* of the truncated cone member 16, and presses the inner-oriented flange 16*a* toward the side of the supporting frictional plane 8*e* of the pressing drive member 8. Further, the truncated cone pressing member 17 is positioned by an adjustment and fixing nut 19, which is screwed in the portion, having a small diameter, of the boss 8*b* of the pressing drive member 8 via a washer 18, and the pressing force of the truncated cone pressing member 17 can be varied with respect to the truncated cone member 16 in response to the screwed position of the abovementioned adjustment and fixing nut 19.

A rotation drive member 15 is fitted to the outside of the outer circumferential frictional plane 16*b* that constitutes the tapered outer circumferential plane of the truncated cone member 16. That is, the rotation drive member 15 is provided with a conical inner-circumferential plane 15*a* suited to the abovementioned outer-circumferential frictional plane 16*b*, and the truncated cone member 16 is fitted to the conical inner-circumferential plane 15*a*. The rotation drive member 15 is brought into contact with and supported by the outer-circumferential frictional plane 16*b* of the truncated cone member 16 and the supporting frictional plane 8*e* of the pressing drive member 8. Also, a hand chain 20 is wound on the rotation drive member 15, wherein by pulling the hand chain 20, a clockwise or counterclockwise rotating force is given to the rotation drive member 15.

A nut 21 is screwed in the end portion at the tip end side in the axial direction of the drive shaft 6 and is devised so as not to become loose by a stop pin 22 driven into the drive shaft 6. The nut 21 can check unnecessary movement toward the tip end side in the axial direction of the pressing drive member 8.

An accommodation hole 15*b* is formed to be open on the base end side in the axial direction on the base end plane in the axial direction of the rotation drive member 15 that is brought into contact with the supporting frictional plane 8*a* of the pressing drive member 8. A movable piece pressing member 23 is placed on the bottom side of the accommodation hole 15*b* and a rolling member 24 that constitutes a movable piece is accommodated therein via the movable piece pressing member 23. The rolling member 24 is formed to be shaped so as to roll in the circumferential direction of the pressing drive member 8, and the movable piece 8 is formed to be spherical in the embodiment, which is preferable in terms of the production processes and securing smoothness on the frictional plane of the pressing drive member 8.

The accommodation hole 15*b* is a means for surrounding the rolling member 24 so that it does not move in the circumferential direction and the radial direction with respect to the rotation drive member 15. If the rolling member 24 is spherical, a cylindrical hole is preferable in terms of manufacture.

The movable piece pressing member 23 has a spring force that operates on the rolling member 24 in a pushing-out direction, by which the rolling member 24 is pushed out of the accommodation hole 15*b*. It is necessary provide the movable piece pressing member 23 with a length necessary enough to add a pressing force to push the rolling member 24 out of the accommodation hole 15*b* till almost half of the diameter of the rolling member 24 is out. It is preferable that the pressing force of the movable piece pressing member 23 is strong enough to cause the rolling member 24 to easily go in and out the accommodation hole 15*b*. "To easily go in and out" means that, when the rotation drive member 15 rotates in the circumferential direction with respect to the pressing drive member 8, the rolling member can be extruded into an engagement groove 80, described later, which is formed in the pressing drive member 8 and can be pushed back along the inclined plane of the engagement groove 80 without any hindrance.

The rolling member 24 is formed to be a sphere whose diameter is slightly smaller than the inner diameter of the accommodation hole 15*b*, and the rolling member 24 compresses the movable piece pressing member 23 and is allowed to enter the accommodation hole 15*b*. Therefore, the rolling member 24 is always pressed in the exit direction of the accommodation hole 15*b*, that is, toward the side of the flange 8*a* of the pressing drive member 8 at the base end side in the axial direction.

On the other hand, the engagement groove 80 is formed at a part in the circumferential direction of the supporting frictional plane 8*e* of the pressing drive member 8. As shown in FIG. 6, the engagement groove 80 is formed on the same radius position as that of the abovementioned accommodation hole 15*b*. The engagement groove 80 has such a depth that approximately half of the abovementioned rolling member 24 can sink in, and is formed so that the rolling member 24 is movable therein in the circumferential direction of the pressing drive member. In the example shown in FIG. 5, the engagement groove 80 is formed at the outer circumferential edge of the flange 8*a* of the pressing drive member 8 and is open to the outer circumferential plane 8*d*. However, since the movement of the rolling member 24 in the radial direction is regulated by the accommodation hole 15*b*, the rolling member 24 is permitted to move in only the circumferential direction with respect to the engagement groove 80 shown in FIG. 5.

The engagement groove 80 is formed to be open in the tip end side plane in the axial direction of the pressing drive member 8. In the example shown in FIG. 5, the end face at the unwinding side is formed perpendicular to the supporting frictional plane 8*e* and forms the fitting plane 80*a*. On the other hand, the winding-up side is formed as an inclined plane 80*b* that is made shallow toward the winding-up side. That is, the engagement groove 80 is recessed from the supporting frictional plane 8*e* to the base end side in the axial direction by only the length equivalent to approx. the half of the rolling member 24 to form the fitting plane 80*a*. After that, an inclined plane 80*b* by which the rolling member 24 is caused to come out and in is formed on the winding-up side after the bottom plane 80*c* parallel to the supporting frictional plane 80*e* is formed so as to slightly extend in the circumferential direction of the pressing drive member 8.

When the rolling member 24 is caused to roll in the unwinding direction in the engagement groove 8 in a state where roughly half section of the rolling member 24 stinks in the accomodation hole 15*b*, the fitting plane 80*a* prevents movement of the rolling member 24 in the unwinding direction and prevents the rotation drive member 15 from rotating with respect to the pressing drive member 8.

When the rolling member 24 that is in contact with the fitting plane 80*a* is guided by the accomodation hole 15*b* and moves in the winding direction, the inclined plane 80*b* permits the rolling member 24 to move in the winding direction while causing the rolling member 24 to sink in the accomodation hole 15*b* against a pressing force of the movable piece pressing member 23.

Next, a description is given of the use of a chain block according to the embodiment.

By a pressing force of the truncated cone pressing member 17, an appointed frictional force operates between the outer circumferential frictional plane 16*b* of the truncated cone member 16 and the conical inner-circumferential plane 15*a* of the rotation drive member 15, and between the supporting frictional plane 8*e* of the pressing drive member 8 and the base end plane in the axial direction of the rotation drive member 15.

If the rotation drive member 15 is caused to rotate in the winding side (clockwise side) by a pulling operation of the hand chain 20, the pressing drive member 8 also rotates, following the rotation thereof, and advances to the base end side in the axial direction by means of a threaded section along the drive shaft 6, wherein the friction members 9 and 10 and the reverse rotation preventing wheel 11 are pressed to the disk 7*a* of the pressure-receiving member 7, and the pressure-receiving member 7 is linked with the pressing drive member 8. And, since the pressure-receiving member 7 and drive shaft 6 rotate altogether, the rotation of the rotation drive member 15 is transmitted to the drive shaft 6. Thus, the rotation of the drive shaft 6 is finally transmitted to the load sheave 3 via a train of speed reducing and transmission gears, thereby winding a load 14 via a chain 13 wound on the load sheave 3.

On the other hand, to the contrary, as the rotation drive member 15 is caused to rotate in the unwinding side (reverse side) by operating the hand chain 20, the pressing drive member 8 retreats to the tip end side in the axial direction along the pressure-receiving member 7, following the rotation of the member 15. Therefore, the pressing drive member 8 is disconnected from the drive shaft 6, and the drive shaft 6 reversely rotates due to the weight of the suspended load 14, whereby the pressing drive member 8 advances to the base end side in the axial direction along the drive shaft 6 and is linked with the pressure-receiving member 7, wherein the unwinding of the load 14 is stopped by the action of the reverse rotation preventing wheel 11 and ratchet claw 12. By repeating the operation, the unwinding (descending) can be carried out sequentially.

However, when winding up an overload, a rotation force applied onto the rotation drive member 15 becomes larger than the frictional force operated by the truncated cone pressing member 17 between the truncated cone member 16 and rotation drive member 15 and between the pressing drive member 8 and rotation drive member 15, and the rotation drive member 15 rotates idly, wherein it is possible to prevent an overload from being lifted.

On the other hand, when unwinding (lowering) an overload, the rotation drive member 15 slides in the direction of the arrow (P) in FIG. 4(*a*) and rotates idly to some degree with respect to the outer circumferential frictional plane 16*b* of the circumferential trapezoidal member 16 and the supporting frictional plane 8*e* of the pressing drive member 8. However, if the accommodation hole 15*b* of the rotation drive member 15 turns relative to the position corresponding to the engagement groove 80 of the pressing drive member 8, the rolling member 24 in the accommodation hole 15*b* partially protrudes in the engagement groove 80 by a pressing force of the movable piece pressing member 15*b*, and the rotation force of the rotation drive member 15 in the unwinding direction P can be transmitted to the pressing drive member 8. After that, an unwinding operation can be carried out as in the case of a normal load. That is, approx. half section of the rolling member 24 is driven into the engagement groove 80 if the rotation drive member 15 is caused to rotate counterclockwise, and it is brought into contact with the fitting plane 80*a* at the unwinding side of the engagement groove 80, wherein it is possible to cause the rotation drive member 15 and pressing drive member 8 to rotate integrally with each other, and forced unwinding is enabled.

Also, in the case where an overload is wound up (lifted), if the accommodation hole 15*b* of the rotation drive member 15 rotates relative to the position corresponding to the engagement groove 80 of the pressing drive member 8 after the rotation drive member 15 slips in the direction of the arrow Q shown in FIG. 4(*b*) and turns idly to some degree with respect to the outer circumferential frictional plane 16*b* of the circumferential trapezoidal member 16 and the supporting frictional plane 8*e* of the pressing drive member 8, the rolling member 24 in the accommodation hole 15*b* is driven into the engagement groove 80 by the pressing force of the movable piece pressing member 23.

But, in this case, since the inclined plane 80*b* at the winding-up side of the engagement groove 80 is formed so as to be inclined to such a degree that the rolling member 24, which is regulated by the accommodation hole 15*b* and moves together therewith, is caused to sink against the movable piece pressing member 23, the rolling member 24 easily passes through the inclined plane of the engagement groove 80, wherein there is no fear that the pressing drive member 8 will be forcibly rotated by the rotation drive member 15 in an overloaded state (See FIG. 4(*b*)). That is, even if the rotation drive member 15 is caused to rotate clockwise (in the direction of the arrow Q), the rolling member 24 idly rotates regardless of the engagement groove

80 of the pressing drive member 8 and existence of the rolling member 24, wherein it is possible to prevent an overload from being wound up (lifted).

The overload-preventing device for a winch according to the invention is not limited to the construction of the abovementioned embodiment, but may be adequately modified.

For example, in the embodiment described above, an engagement groove 80 is formed in the pressing drive member 8 while an accommodation hole 15*b* that accommodates a movable piece pressing member 23 and a rolling member 24 is formed in the rotation drive member 15. To the contrary, an engagement groove may be formed in the rotation drive member 15 while an accommodation hole that accommodates the movable piece pressing member 23 and a rolling member 24 is formed in the pressing drive member 8. In this case, the rolling member 24 is pressed to the side of the rotation drive memeber 15 by the movable piece pressing member 23, and the engagement groove of the rotation drive member 15 is formed on the fitting plane by forming the end face at the winding-up side thereof perpendicular to the base end face in the axial direction of the rotation drive member 15. Further, the unwinding side thereof is constructed so that it becomes an inclined plane which becomes shallow toward the unwinding (lowering) side. Since all the other constructions are the same as those in the abovementioned embodiment, overlapping description thereof is omitted.

What is claimed is:

1. An overload-preventing device for a winch, including:

a drive shaft that transmits a rotating force to a load sheave;

a pressure-receiving member that is fixed at said drive shaft;

a pressing drive member that is screwed with said drive shaft so as to advance the retreat, and presses and rotates said pressure receiving member via a reverse rotation preventing wheel that is fitted to the outside of said pressure receiving member and via a pair of friction members that are disposed at both sides thereof;

a truncated cone member, the diameter of which is reduced toward the side of said pressure-receiving member, that is not permitted to rotate with respect to said pressing drive member but is movable in the axial direction; and a rotation drive member, having an inner circumferential surface following the outer circumferential surface of said truncated cone member, which is outwardly fitted so that it is brought into frictional contact with the outer circumferential surface of said truncated cone member and the tip end side face in the axial direction of said pressing drive member;

in which said truncated cone member is pressed toward said pressing drive member by a truncated cone pressing member;

wherein an accommodation hole for accommodating a movable piece is formed in said rotation drive member so as to open in the contact surface with said pressing drive member;

said movable piece is retained so as to come out of and sink in the axial direction in said accommodation hole but not to move in the circumferential direction of said rotation drive member;

said movable piece is pressed to the side of said pressing drive member by said movable piece pressing member;

an engagement groove having a depth in which a part of said movable piece has infiltrated is formed on the same radius as that of said accommodation hole on the contact surface of said pressing drive member;

said engagement groove has a length by which said movable piece can move in the circumferential direction;

an end portion at a winding-up side of said engagement groove is formed so that it becomes shallow toward the winding-up side to become consecutive on the contact surface; and an end portion at an unwinding side of said engagement groove is formed on the fitting plane on which said movable piece cannot move in the unwinding direction.

2. The overload-preventing device for a winch according to claim 1, wherein said pressing drive member has a flange portion formed at the side of said pressure-receiving member, and has a boss portion extending and formed in the direction opposed to said pressure-receiving member;

said truncated cone member is spline-fitted to the base end portion of said boss portion, and said truncated cone pressing member is fitted to the outer side of the intermediate portion thereof and is positioned by a nut; and said flange portion of said pressing drive member has one end thereof brought into contact with said friction member while having the other end thereof brought into contact with said rotation drive member.

3. An overload-preventing device for a winch, including:

a drive shaft that transmits a rotating force to a load sheave;

a pressure-receiving member that is fixed at drive shaft;

a pressing drive member that is screwed with said drive shaft so as to advance the retreat, and presses and rotates said pressure-receiving member via a reverse rotation preventing wheel that is fitted to the outside of said pressure receiving member and via a pair of friction members that are disposed at both sides thereof;

a truncated cone member, the diameter of which is reduced toward the side of said pressure-receiving member, that is not permitted to rotate with respect to said pressing drive member but is movable in the axial direction; and a rotation drive member, having an inner circumferential surface following the outer circumferential surface of said truncated cone member, which is outwardly fitted so that it is brought into frictional contact with the outer circumferential surface of said truncated cone member and the tip end side face in the axial direction of said pressing drive member;

in which said truncated cone member is pressed toward said pressing drive member by a truncated cone pressing member;

wherein an accommodation hole for accommodating a movable piece is formed in said rotation drive member so as to open in the contact surface with said pressing drive member;

said movable piece is retained so as to come out of and sink in the axial direction in said accommodation hole but not to move in the circumferential direction of said rotation drive member;

said movable piece is pressed to the side of said rotation drive member by said movable piece pressing member;

an engagement groove having a depth in which a part of said movable piece has infiltrated is formed on the same radius as that of said accommodation hole on the contact surface of said rotation pressing drive member;

said engagement groove has a length by which said movable piece can move in the circumferential direction;

an end portion at an unwinding side of said engagement groove is formed so that it becomes shallow toward the unwinding side to become consecutive on the contact surface; and an end portion at an winding-up side of said engagement groove is formed on the fitting plane on which said movable piece does not move in the winding-up direction.

4. The overload-preventing device for a winch according to claim 3, wherein said pressing drive member has a flange portion formed at the side of said pressure-receiving member, and has a boss portion extending and formed in the direction opposed to said pressure-receiving member;

said truncated cone member is spline-fitted to the base end portion of said boss portion, and said truncated cone pressing member is fitted to the outer side of the intermediate portion thereof and is positioned by a nut; and said flange portion of said pressing drive member has one end thereof brought into contact with said friction member while having the other end thereof brought into contact with said rotation drive member.

* * * * *